United States Patent [19]

Gessler

[11] 4,117,999

[45] Oct. 3, 1978

[54] FURNITURE LEG EXTENDERS

[75] Inventor: Robert U. Gessler, Wilton, Conn.

[73] Assignee: Easy Riser, Inc., Wilton, Conn.

[21] Appl. No.: 832,647

[22] Filed: Sep. 12, 1977

[51] Int. Cl.[2] ..... F16M 11/20

[52] U.S. Cl. ..... 248/188.2; 248/188.9

[58] Field of Search ..... 248/188.2, 188.4, 188.5, 248/188.8, 188.9, 226.3

[56] References Cited

U.S. PATENT DOCUMENTS

| | | | |
|---|---|---|---|
| 400,033 | 3/1889 | Alliger | 248/188.2 |
| 2,107,629 | 2/1938 | Dallas | 248/188.2 |
| 2,371,460 | 3/1945 | Needham | 248/188.2 X |
| 2,702,222 | 2/1955 | Puls et al. | 248/188.5 |
| 2,890,824 | 6/1959 | Derby et al. | 248/188.2 X |
| 2,935,813 | 5/1960 | Berman et al. | 248/188.2 |
| 3,888,354 | 6/1975 | Margolin et al. | 248/226.3 X |

FOREIGN PATENT DOCUMENTS

| | | | |
|---|---|---|---|
| 34,280 | 8/1905 | Switzerland | 248/188.5 |
| 59,113 | 3/1912 | Switzerland | 248/188.2 |
| 313,811 | 6/1929 | United Kingdom | 248/188.2 |

*Primary Examiner*—Lawrence J. Staab
*Attorney, Agent, or Firm*—B. B. Olive

[57] ABSTRACT

A pair of extension members are adapted to be adjustably secured to the ends of chair, bed or other furniture legs as a means of extending the legs to a chosen length. Bolt and wing nut arrangments are used to locate and secure the extension members to the furniture legs. Also, glide or caster arrangements may be adjustably and angularly secured to the leg extenders.

1 Claim, 10 Drawing Figures

FURNITURE LEG EXTENDERS

BACKGROUND OF THE INVENTION

1. Field of the Invention

The invention relates to extenders for chair, bed and other furniture legs.

2. Description of the Prior Art

A major problem for the arthritic patient is the transfer to and from his bed. This transfer is especially difficult when the height of the bed is so low that the patient has difficulty regaining his balance after the transfer. Doctors have recommended placing blocks under the bed legs to elevate the bed. The Allied Health Professions Section of the Arthritis Foundation has suggested that the bed elevation be raised by making blocks of wood with recesses to fit the bed legs. Each block has solid outer walls and a recess which is filled with sand or small blocks to bring the bed to the proper height. For stability, each leg is inserted into the recess for at least one-third of the block's height.

While the prior practice of elevating bed mattresses facilitates sliding-sitting transfers to and from wheelchairs by making the bed level with the wheelchair and enables the patient to stand more easily, it has been discovered by the present inventor that by raising the height of furniture to a specific height, pain and joint stress due to sitting and rising can be virtually eliminated. This exact height, which varies with each individual, is referred to as the "comfort zone". The comfort zone for most individuals is approximately 18 to 24 inches from the floor. In cases of chairs and sofas with soft cushions and beds with soft mattresses, the comfort zone is measured from the floor to the depressed position of the cushion or mattress. By elevating each article of furniture used, the arthritic patient can greatly reduce pain and joint stress, reduce his intake of medication and reduce the deterioration of his joints.

U.S. Pat. No. 2,107,629 discloses an adjustable chair leg extension. This patent uses a holding element which is secured to the bottom of chair leg by a screw. Each chair leg must have one of these holding elements rigidly secured thereto. Also, a cylindrical portion is adapted to fit around a chair leg and have bands tightened thereon to draw the cylindrical member together. This offers a disadvantage in that the size of chair leg is dependent on the inside diameter of the cylindrical portion.

An improved furniture leg extender is described in applicant's prior U.S. Pat. No. 3,985,323. The previous practice of placing chair or bed legs on books or wooden blocks was much too dangerous and is no longer required. The recessed block suggested by The Arthritis Foundation had to be custom made for each bed leg size and was too unstable for use on chairs. The extender described in U.S. Pat. No. 3,985,323 also overcame this disadvantage.

While substantially all of the disadvantages of the prior art were overcome by applicant's leg extender as covered in U.S. Pat. No. 3,985,323, applicant has found through use that an easier means of adjustment of the leg extender was needed. Also, a more rigid device was desired. A more pleasing appearance which would better match the leg of the article being raised and means to facilitate easy movement of the furniture by an arthritic person were other disadvantages which applicant has overcome with the furniture leg extender of the present invention. Further, the present invention does not require various size block supports as did the extender shown in U.S. Pat. No. 3,985,323.

SUMMARY OF THE INVENTION

The leg extender of the present invention includes a pair of formed metal extender plates which are disclosed in two different shapes and which are secured about the leg which is to be extended by bolt/wing nut arrangements which pass through opposed sets of fastener holes. One of the bolt/wing nut arrangements is adjusted vertically to locate and provide the support upon which the furniture leg resides once all of the bolt/wing nut devices are tightened to bind the plates against the leg. A threaded mounting plate is made integral with one of the metal extending plates and provides means for adjustably securing casters or glides to the end of the extender adjacent the floor. The space between the metal extender plates can be adjusted to accommodate a wide range of leg sizes. Various degrees of elevation are achieved by appropriate vertical adjustment to the bolt/wing nut device upon which the furniture leg resides. Provision is also made for angular positioning of the casters or glides to compensate for curved legs.

DESCRIPTION OF THE PREFERRED EMBODIMENT

Three forms of the leg extender of the invention are illustrated and are identified as extenders 10, 10' and 10''. All such forms of the invention are similar in the sense of each extender comprising a pair of formed rigid metal plates which are clamped to the leg by an upper pair of bolts having wing nuts for tightening an a single lower bolt which acts both to clamp the plates and to provide a support and stop for the bottom of the leg. The various embodiments of the invention are also each characterized by one of the plates having at its lower end means to receive either a glide or caster. In two embodiments, leg extenders 10 and 10', such means comprises a small plate having a threaded hole to adjustably mount the glide or caster, as the case may be. In the other embodiment, leg extender 10'', such means comprises a tiltable tube arrangement adapted to receive the glide or caster and which allows the glide or caster stem to be positioned substantially vertically when the extender is used on an outwardly angled or curved leg.

Figure 1:
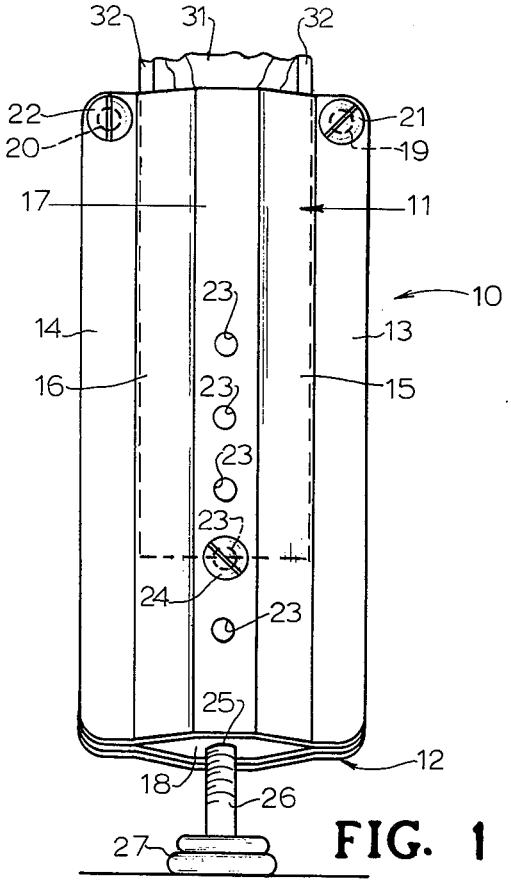
FIG. 1 is a front elevation view of the leg extender of the present invention with a glide installed.
Figure 2:
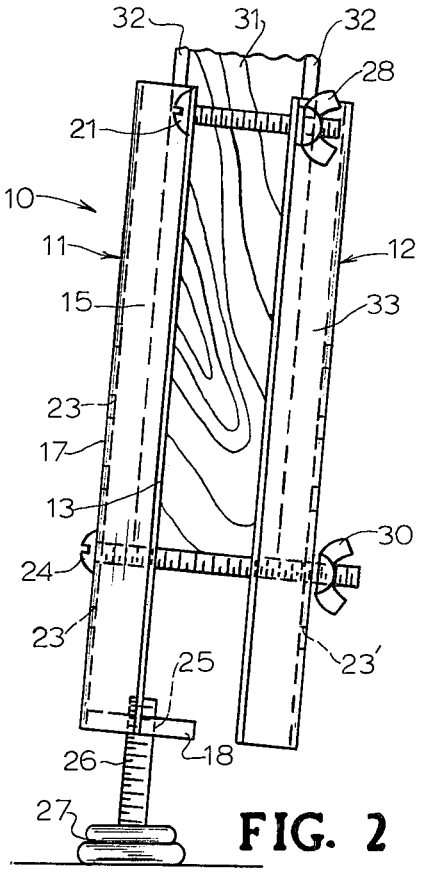
FIG. 2 is a side elevation view of the extender shown in FIG. 1.
Figure 3:
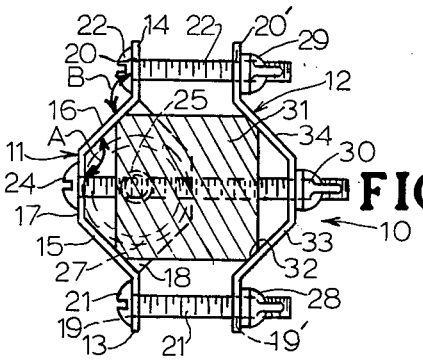
FIG. 3 is a top view of the leg extender of FIGS. 1 and 2.

Referring first to FIGS. 1, 2 and 3, furniture leg extender 10 includes a pair of formed metal extender plates 11, 12 of similar shape designed to be clamped against opposite outer surfaces of the leg. Outside extender plate 11 has a pair of flat sides 13, 14, a pair of outwardly angled walls 15, 16, a flat face surface 17 and a lower, integral glide or caster support plate 18. Surface 17 has an interior included angle A of approximately 120° with respect to walls 15, 16 and an exterior included angle B of approximately 120° with respect to sides 13, 14. The flat walls 13, 14 have respective holes 19, 20 which are adapted to receive a pair of upper bolts 21, 22 respectively for clamping plates 11, 12 together. Face surface 17 has a predetermined number of holes 23 in the lower area thereof, any one of which may receive the leg support bolt 24 to provide adjustable vertical support. Bolt 24 also serves to clamp plates 11, 12 together. Plate 18 has a threaded hole 25 therein for threadably receiving threaded shaft 26 of floor glide 27 to provide leveling adjustment. Metal extender plate 12 is similar in construction to plate 11 with the exception that plate 12 does not have a plate corresponding to plate 18 of metal extender plate 11. The pair of upper bolts 21, 22 pass through holes 19', 20' (FIG. 3) corresponding to holes 19, 20 of plate 11 and are tightened by wing nuts 28, 29. A series of holes 23' (FIG. 2) are also provided in plate 12 corresponding to holes 23 of plate 11. The single lower leg support bolt 24 passes through a pair of corresponding holes 23, 23' at a selected vertical position and is tightened by wing nut 30.

Once furniture leg extender unit 10 is loosely assembled as described above, it can be fitted onto the furniture leg 31. Leg 31, in the example being described, is assumed to be substantially square with slightly beveled edges 32. Edges 32 of such a leg shape may reside against the internal surfaces of outwardly angled walls 15, 16 of extender plate 11 and outwardly angled walls 33, 34 of plate 12 with leg 31 resting on lower bolt 24 for support. Wing nuts 28, 29 and 30 are appropriately tightened so that extender plates 11, 12 are drawn together about leg 31.

Figure 4:
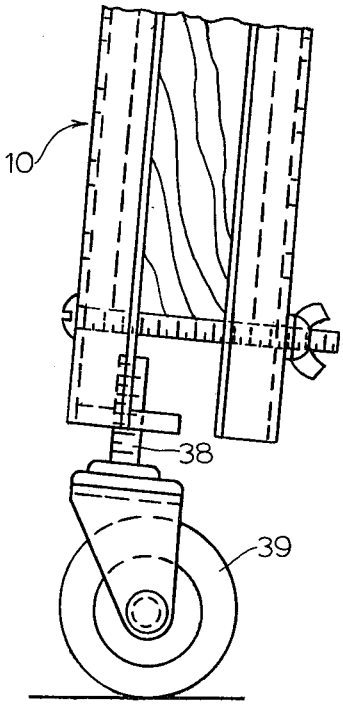
FIG. 4 is a fragmentary side elevation view of the leg extender of FIG. 2 with a caster installed.

Height is adjustable in two ways. First, minor height or leveling adjustments can be made by screwing the respective floor glide 27 up or down in plate 18. Secondly, larger height adjustments are made by positioning lower bolt 24 in a higher or lower set of holes 23, 23' in plates 11 and 12. Casters may be employed instead of glides as illustrated in FIG. 4 in which extender 10 is identical to the construction of FIGS. 1, 2 and 3 except that plate 18 threadably receives shaft 38 of floor caster 39. Floor caster 39 is thus vertically adjustable as was glide 27.

Figure 5:
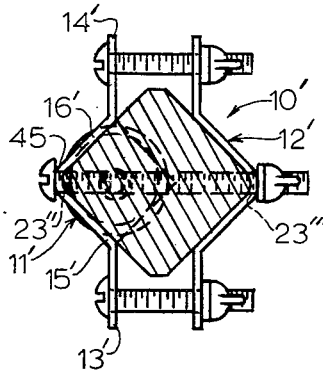
FIG. 5 is a top plan view illustrating an alternative shape of the metal extender plates employed in the present invention.

FIG. 5 discloses an alternative embodiment of the furniture leg extender of the present invention and is identified as leg extender 10'. Leg extender 10' is similar to leg extender 10 except as to the shape of the pair of plates. In this regard, it will be noted that metal extender plate 11' does not have a flat central surface corresponding to surface 17 of leg extender plate 11. Instead, outwardly right angled walls 15', 16' coverge at an edge 45 as illustrated. Holes 23'', 23''', corresponding to holes 23, 23' of FIGS. 1–4, are spaced along the edge 45. Flat sides 13', 14' are slightly larger in width than were sides 13, 14. The change in shape provides more surface of walls 15', 16' for contact with furniture leg 31, since walls 15', 16' are wider and since leg 31 is turned so that a pair of the beveled edges fit in the angled area at the edge 45 of walls 15', 16'. Metal extender plate 12' corresponds in construction to that of plate 11' except that no glide or caster support plate is provided. Mounting of furniture leg extender 10' is like that of extender 10 as previously explained.

Turning now to FIGS. 6 through 10, furniture leg extender 10'' provides means for achieving vertical load support when the furniture leg 50 is curved or angled outwardly from the base of the piece of furniture as commonly found in chairs. Leg extender 10'' is composed of formed metal extender plates 51, 52 and angular adjustment means 53. Extender plate 51 is identical in construction to plate 12' of furniture leg extender 10' and has a pair of flat sides 54, 55 (not shown) and a pair of outwardly angled walls 56, 57 (not shown). Walls 56, 57 merge at edge 60 along which holes 61 are spaced (see FIGS. 7 and 8). Side 54 also has a hole 62 and side 55 has hole 63 (not shown) in their respective upper area and which function as the previously described holes 19', 20' for receiving the upper pair of clamping bolts 85, 87.

Figure 6:
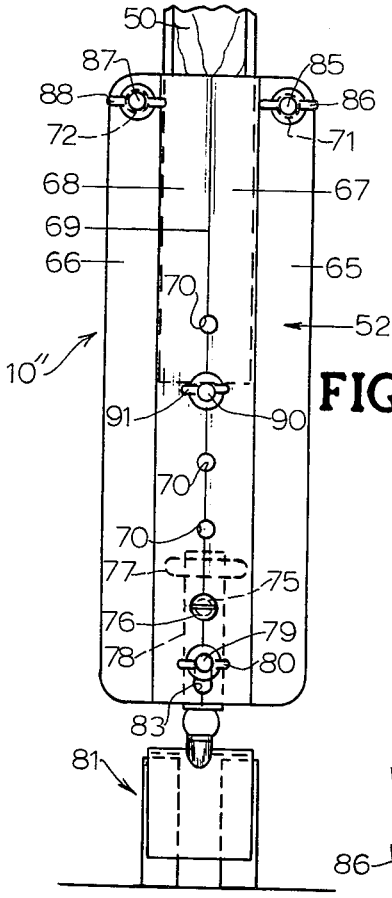
FIG. 6 is a rear elevation view of a further alternative construction in which means is provided for adjusting the position of the glide or caster to compensate for the angular displacement or curvature of the furniture leg.
Figure 9:
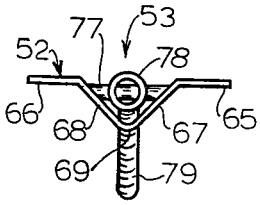
FIG. 9 is a top plan view of the metal extender plate which mounts the angular displacement compensation apparatus.

Leg extender plate 52 is shaped similar to plate 51 except that plate 52 has the angular adjustment means 53 of the invention mounted at its lower end. Plate 52, in the embodiment illustrated, has a pair of flat sides 65, 66 and a pair of outwardly angled walls 67, 68. Walls 65, 66 merge at edge 69 along which holes 70 mating with holes 61 are spaced as seen in FIG. 6 and which are adapted to receive the lower support bolt 90 at a selected vertical portion. Side 65 has a hole 71 and side 66 has a hole 72 in their respective upper areas and which function as the previously described holes 19, 20 for receiving the upper pair of tightening bolts. Leg extender plate 52 also has a hole 75 which threadably receives threaded screw 76. Screw 76 is movable inwardly and outwardly to position the caster mounting sleeve 78. A horizontal shaft 77 is integrally secured by welding between angled walls 67, 68 as seen in FIG. 9 and has sleeve 78 pivotally mounted thereon. A threaded shaft 79 has one end integrally secured to sleeve 78 and the opposite end extending outwardly through slot 83 and mounting wing nut 80. Shaft 82 of caster unit 81 is press-fitted into sleeve 78 as best seen in FIGS. 7 and 8.

The furniture leg extender 10'' as described above and as illustrated in FIGS. 6–9 is mounted on furniture leg 50 by placing the upper pair of bolts 85, 87, respectively, through holes 62, 71 and 63 (not shown), 72 and securing the same with wing nuts 86, 88. Lower bolt 90 is passed through a selected one of holes 61 in plate 51 and through holes 70 in plate 52 and is secured by wing nut 91 with leg 50 resting on bolt 90 (see FIGS. 6, 7, 8).

Figure 7:
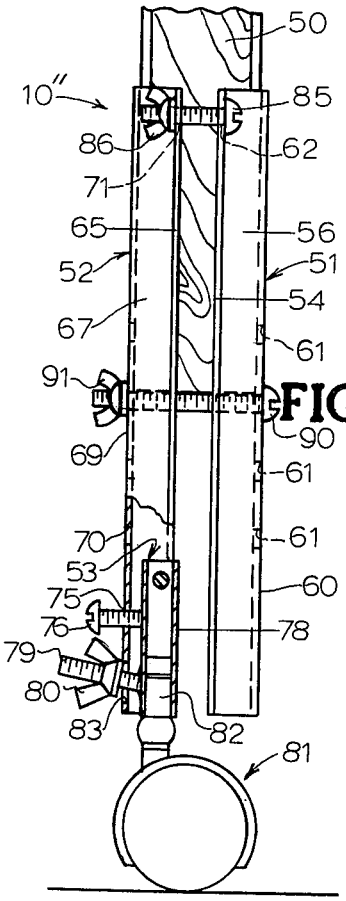
FIG. 7 is a side elevation view of the FIG. 6 leg extender with the angular displacement compensation apparatus in a vertical position such as would be the case when the furniture leg is straight and is not angled or curved.
Figure 8:
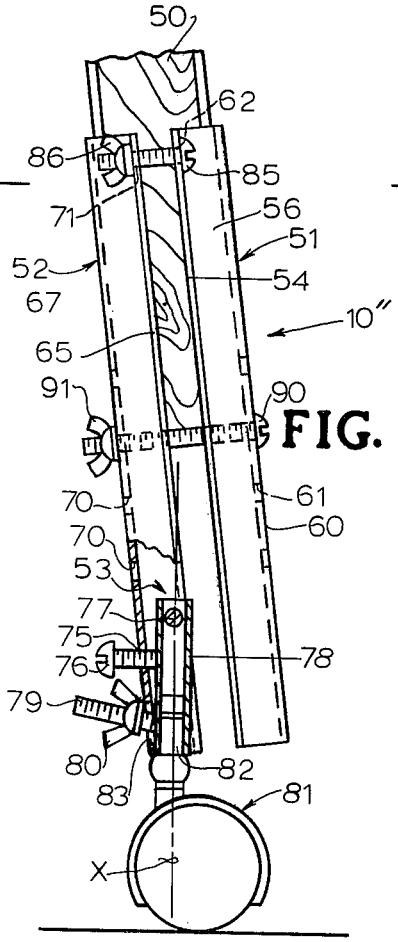
FIG. 8 is a side elevation view similar to that of FIG. 7 but with the angular displacement compensation apparatus adjusted so that the caster central X axis remains vertical when the leg extender is mounted on an outwardly angled furniture leg.

FIG. 7 illustrates how leg extender 10'' is used on a piece of furniture having relatively straight legs. In this case, sleeve 78 is placed in a vertical position and wing nut 80 is tightened until it contacts edge 69. Screw 76 is next tightened until it comes into snug contact with sleeve 78. These two tightening operations place sleeve 78 in a bind between screw 76 and shaft 79 and holds sleeve 78 vertical as in FIG. 7. When leg extender 10" is used on a piece of furniture having legs which extend downward from its base at an angle as in FIG. 8, leg extender 10" may be adjusted so that sleeve 78 still remains vertical. This movement is achieved by loosening screw 76 and then tightening wing nut 80 until sleeve 78 is brought into the desired vertical position at which point screw 76 is tightened until it bears against sleeve 78. Sleeve 78 is once again in a bind between screw 76 and shaft 79. During this adjustment operation, sleeve 78 is pivoting about shaft 77. While not illustrated in FIGS. 6–9, it will be understood that glides can be substituted for the casters shown in FIGS. 6–9.

Figure 10:
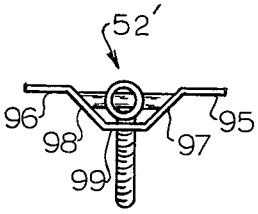
FIG. 10 is a top plan view similar to that of FIG. 9 but of an alternative metal extender plate construction.

FIG. 10 illustrates an alternative plate member 52' for use with a leg extender of the type illustrated in FIGS. 6 through 9. Plate member 52' has flat sides 95, 96, angled walls 97, 98 and flat face surface 99. The remaining construction of plate 52' is similar to that of plate 52 as far as the described holes are concerned. The opposing plate member to plate 52 can be identical to plate 12 of leg extender 10 and for employment in the manner of FIG. 3.

In summary, the leg extender of the invention as identified by the three embodiments 10, 10' and 10" has been found to be versatile and reliable for extending the legs of furniture, e.g., chairs and beds, for arthritic patients. A very safe, inexpensive, cosmetically attractive and simple extension is provided. With the option of glides or casters for mobility, a whole new dimension to comfort is provided for the disabled person. The leg extenders of the present invention offers obvious advantages for hospital, nursing facilities and home, i.e., ease of moving furniture for disabled people and actual patient transfer from room to room. Adjustment to the individual patient's comfort zone is permitted through raising each piece of furniture in daily use to the exact height at which an individual person can sit down or rise without experiencing pain or adding stress and with ease of adaptability to either straight, curved or angled type furniture legs.

What is claimed is:

1. A device for extending the length of the leg on a conventional chair, bed, or other furniture without altering the leg exterior surfaces comprising, in combination:

(a) a first rigid metal integral elongated plate member having a pair of outer coplanar rectangular flat sections and therebetween a plurality of interconnecting rectangular flat sections in fixed angular relation adapted for vertical positioning to engage and partially surround with an inner side thereof lower outer surface portions of said leg, having a pair of upper bolt receiving holes formed in upper outer edge portions of said coplanar sections, and having a series of vertically spaced lower bolt receiving support holes formed along a vertical line centrally of said middle sections in a lower portion of said plate member;

(b) a second rigid metal integral elongated plate member having a pair of outer coplanar rectangular flat sections adapted to be disposed parallel to and opposite the outer coplanar sections of said first plate member, having a pair of upper bolt holes located for being mated with and disposed opposite to the upper pair of bolt holes of said first plate member, having a series of vertically spaced lower bolt receiving support holes located for being mated with and disposed opposite to the series of vertically spaced lower bolt receiving support holes of said first plate member, having a plurality of interconnecting middle rectangular flat sections in fixed angular relation between the said outer coplanar sections of said second plate member adapted for vertical positioning to engage and partially surround with an inner side thereof opposite lower outer surface portions of said leg;

(c) stem-receiving means mounted on an inner lower central portion of one of said plate members and adapted to receive the stem portion of a floor contacting device, said stem-receiving means comprising a generally vertically disposed stem-receiving tube member pivotally mounted within a said lower portion of a selected one of said plate members and including screw adjustment means in such selected plate member to fix and secure the angular relation of said tubular stem member with respect to the said selected plate member on which the same is mounted thereby enabling said device to adapt to an outwardly angled leg for providing vertically positioned stem support therefor;

(d) a pair of upper bolt members adapted to be mounted in said upper bolt receiving holes for clamping the upper outer coplanar sections of said plate members together to secure the upper inner portions of said plate middle sections against said leg;

(e) a single lower bolt member mounted in a selected set of said lower bolt receiving holes and being adapted to support the bottom of said leg thereon and clamp together the lower portions of said middle sections of of said plate members about said leg; and (f) a floor-engaging device having a stem mounted in said stem-receiving means.

* * * * *